United States Patent [19]

Vogt et al.

[11] Patent Number: 4,680,063

[45] Date of Patent: Jul. 14, 1987

[54] METHOD FOR REFINING MICROSTRUCTURES OF TITANIUM INGOT METALLURGY ARTICLES

[75] Inventors: Russell G. Vogt, Xenia; Daniel Eylon, Dayton; Francis H. Froes, Xenia, all of Ohio

[73] Assignee: The United States of America as represented by the Secretary of the Air Force, Washington, D.C.

[21] Appl. No.: 896,035

[22] Filed: Aug. 13, 1986

[51] Int. Cl.[4] ..... C22F 1/18

[52] U.S. Cl. ..... 148/11.5 F; 148/133

[58] Field of Search ..... 148/133, 11.5 F; 423/644, 648 R

[56] References Cited

U.S. PATENT DOCUMENTS

| | | | |
|---|---|---|---|
| 4,415,375 | 11/1983 | Lederich et al. | 148/11.5 F |
| 4,482,398 | 11/1984 | Eylon et al. | 148/11.5 F |
| 4,505,764 | 3/1985 | Smickley et al. | 148/133 |
| 4,534,808 | 8/1985 | Eylon et al. | 148/133 |
| 4,536,234 | 8/1985 | Eylon et al. | 148/133 |
| 4,543,132 | 9/1985 | Berczik et al. | 148/11.5 F |

FOREIGN PATENT DOCUMENTS

| | | | |
|---|---|---|---|
| 639993 | 12/1978 | U.S.S.R. | 148/133 |

OTHER PUBLICATIONS

Kolachov et al, "The Influence of Hydrogen in Hot Deformability of Titanium Alloys with Different Phase Compositions Titanium and Titanium Alloys, vol. 3, Plenum Press, 1982, pp. 1833–1842.

Kerr et al, "Hydrogen as an Alloying Element in Titanium (Hydrovac)", Titanium '80 Science and Technology, 1980, pp. 2477–2486.

*Primary Examiner*—Christopher W. Brody

*Attorney, Agent, or Firm*—Charles E. Bricker; Donald J. Singer

[57] ABSTRACT

The microstructure of forged titanium alloy components is improved by beta-transus heat treating the components, hydrogenating the components at an elevated temperature, cooling the thus-hydrogenated components to room temperature, dehydrogenating the components at an elevated temperature and cooling the dehydrogenated components to room temperature.

8 Claims, 4 Drawing Figures

METHOD FOR REFINING MICROSTRUCTURES OF TITANIUM INGOT METALLURGY ARTICLES

RIGHTS OF THE GOVERNMENT

The invention described herein may be manufactured and used by or for the Government of the United States for all governmental purposes without the payment of any royalty.

BACKGROUND OF THE INVENTION

This invention relates to the processing of forged titanium articles to improve the microstructure of such articles.

High strength titanium alloys are widely used in aerospace applications. Considerable research has been directed toward increasing strength and fatigue properties of titanium alloy airframe components.

Accordingly, it is an object of the present invention to provide an improved process for processing forged titanium alloy components.

Other objects, aspects and advantages of the present invention will become apparent to those skilled in the art from a reading of the following detailed description of the invention.

SUMMARY OF THE INVENTION

In accordance with the present invention there is provided an improved process for fabricating forged titanium alloy components which comprises the steps of forging a titanium alloy billet to a desired shape, beta solution heat treating the shaped component, hydrogenating the resulting treated component at an elevated temperature, cooling the hydrogenated component to room temperature and dehydrogenating the component.

The resulting structure comprises a fine lamellar alpha structure in a matrix of discontinuous beta phase.

DETAILED DESCRIPTION OF THE INVENTION

Figure 1:
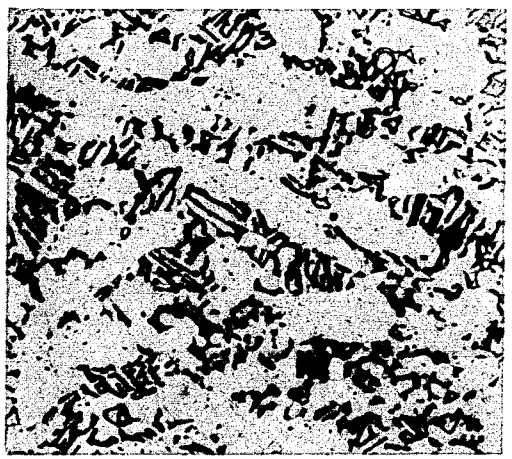
FIG. 1 is a 400× photomicrograph of mill annealed Ti-6Al-4V.

The present invention is directed to a process for providing improved properties in titanium alloys. The invention was developed with respect to the alloy Ti-6Al-4V and will be described with respect to this alloy. The invention is useful for processing the series of titanium alloys known as alpha, near-alpha and alpha-beta alloys.

The first step of the process of this invention is a forging step, carried out at a temperature in the hot working regime of the alloy, preferably about 25°–100° C. below the beta-transus temperature of the alloy. Isothermal forging, with allowance for reasonable temperature variations in the dies, i.e., up to about 20° C., is presently preferred.

Following the forging step, the component is beta-solution heat treated. Such treatment is accomplished by heating the component to approximately the beta-transus temperature of the alloy, i.e., from about 4% below to about 10% above the beta-transus temperature (in °C.), followed by rapid cooling to obtain a martensitic structure. The period of time at which the component is held at or near the beta-transus temperature can vary from about 5 minutes to about 4 hours, depending upon the cross-section of the component. The component is then rapidly cooled. Cooling may require water or oil quenching for large pats whereas static, forced air or gas cooling may be adequate for small parts.

Following beta solution heat treatment, the component is hydrogenated to a level of about 0.1 to 2.3 weight percent hydrogen. Hydrogenation is carried out using a suitable hydrogenating apparatus. Because hydrogen is highly flammable, it is preferred to carry out the hydrogenation using a mixtue of hydrogen and an inert gas, such as helium or argon. The temperature at which hydrogen is added to the alloy can range from about 50% to about 96% of the beta transus temperature in degrees C. For the alloy Ti-6Al-4V, the temperature of hydrogen addition can range from about 540° C. to about 955° C.

Following the hydrogenation step, the article is cooled from the hydrogenation temperature at a controlled rate to about room temperature. The rate is controlled to be about 5° to 40° C. per minute. This controlled rate cooling step is critical to providing the desired microstructure. If the rate is too high, cracking and distortion of the article may result. A slower cooling rate may lead to the formation of a coarse acicular structure which will not provide satisfactory fatigue properties.

Dehydrogenation of the hydrogenated article is accomplished by heating the article under vacuum to a temperature in the range of about 50% to 96% of the beta-transus temperature of the alloy. The time for the hydrogen removal will depend on the size and cross-section of the article, the volume of hydrogen to be removed, the temperature of dehydrogenation and the level of vacuum in the apparatus used for dehydrogenation. The term "vacuum" is intended to mean a vacuum of about $10^{-2}$ mm Hg or less, preferably about $10^{-4}$ mm Hg or less. The time for dehydrogenation must be sufficient to reduce the hydrogen content in the article to less than the maximum allowable level. For the alloy Ti-6Al-4V, the final hydrogen level must be below 120 ppm to avoid degradation of physical properties. Generally, about 15 to 60 minutes per one-half inch of cross-section, at dehydrogenation temperature and under vacuum, is sufficient to ensure substantially complete evolution of hydrogen from the article. Heating is then discontinued and the article is allowed to cool, at the previously described controlled rate, to room temperature.

The benefits of the method of this invention are illustrated in FIGS. 1–4. A typical microstructure of mill annealed Ti-6Al-4V is shown in FIG. 1. The structure is a mixture of equiaxed alpha separated by a small amount of intergranular beta.

Figure 2:
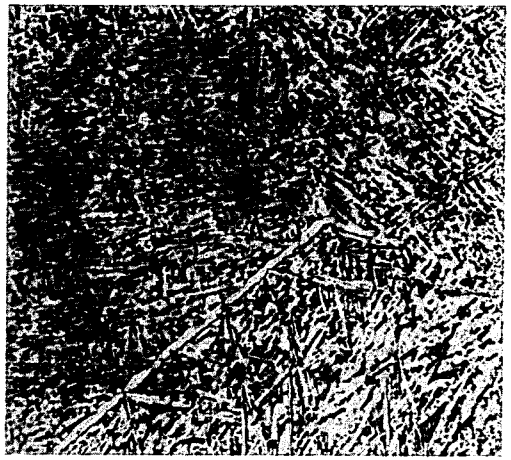
FIG. 2 is a 600× photomicrograph of a Ti-6Al-4V specimen processed according to the present invention.

FIG. 2 illustrates a structure resulting from beta solution treatment/hydrogenation/cool down/dehydrogenation in accordance with the present invention.

The structure consists of fine lamellar alpha in a matrix of discontinuous beta.

Figure 3:
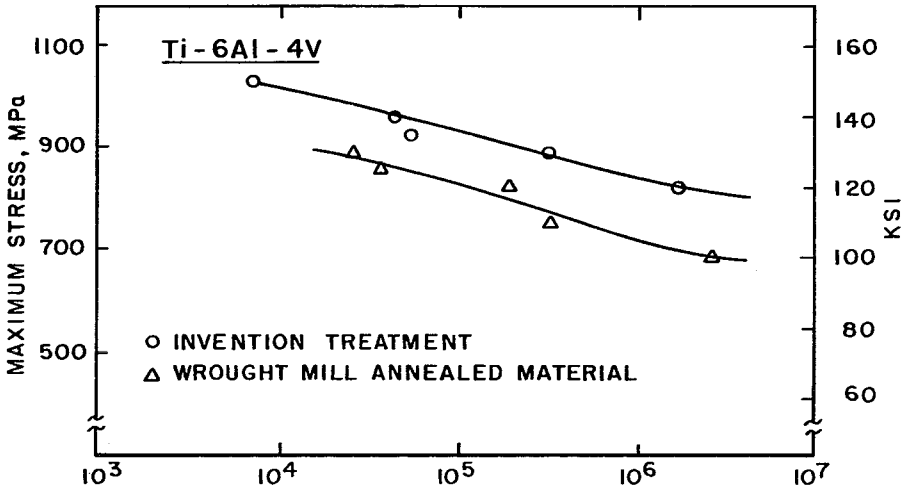
FIG. 3 illustrates the smooth axial fatigue strength of wrought mill annealed material compared to wrought material treated according to the invention.

FIG. 3 illustrates the smooth axial fatigue strength of a series of wrought specimens. The lower curve represents the fatigue data of a series of wrought mill annealed specimens. The upper curve represents the fatigue data of a series of wrought specimens which were treated in accordance with the invention as follows: beta solution heat treatment at 1025° C. for 20 minutes followed by water quenching, hydrogenation at about 595° C. to 1.4 w% hydrogen, cool to room temperature, dehydrogenation at about 595° C. to less than 120 ppm hydrogen. The tensile properties of these specimens are compared to wrought mill annealed specimens in the following table.

TABLE

| Condition | 0.2%, YS, MPa (Ksi) | UTS MPa (Ksi) | EL % | RA % | Ratio $\sigma_f$/UTS* |
|---|---|---|---|---|---|
| Mill Annealed | 923(134) | 978(142) | 17 | 44 | 0.70 |
| Treated | 1069(155) | 1117(162) | 8 | 17 | 0.74 |

*fatigue strength at $5 \times 10^6$ cycles vs. UTS

Figure 4:
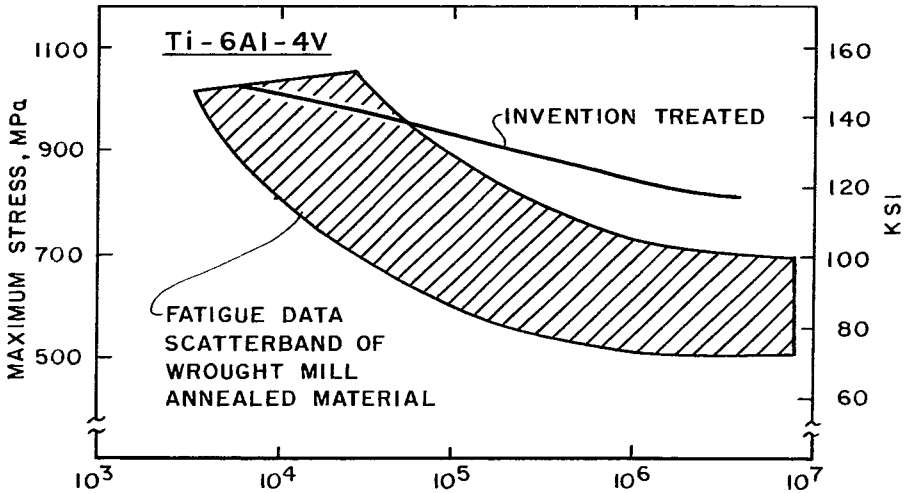
FIG. 4 illustrates the smooth axial fatigue strength of specimens treated according to the invention compared to the scatterband of mill annealed wrought material.

FIG. 4 illustrates the smooth axial fatigue strength of the series of wrought specimens described above compared to the scatterband of mill annealed wrought material.

The method of this invention is generally applicable to the manufacture of aircraft components, as well as non-aerospace components.

Various modifications may be made to the present invention without departing from the spirit and scope of the invention.

We claim:

1. A process for fabricating forged titanium alloy components which comprises the steps of (a) forging a titanium alloy billet to a desired shape;

(b) heat treating the shaped component at about 4% below to about 10% above the beta-transus temperature of the alloy for about 5 minutes to 4 hours, followed by rapid cooling;

(c) hydrogenating the component at an elevated temperature to a desired hydrogen level;

(d) cooling the thus-hydrogenated component at a controlled rate to room temperature;

(e) dehydrogenating the thus-cooled, hydrogenated component at an elevated temperature to a desired hydrogen level; and (f) cooling the thus-dehydrogenated component at a controlled rate to room temperature.

2. The process of claim 1 wherein said hydrogenating step is conducted at a temperature of about 50% to 96% of said beta-transus temperature.

3. The process of claim 2 wherein said component is hydrogenated to a level of about 0.1 to 2.3 weight percent hydrogen.

4. The process of claim 1 wherein said cooling step (d), following hydrogenation, is conducted at a cooling rate of about 5° to 40° C. per minute.

5. The process of claim 1 wherein said dehydrogenation step is conducted at a temperature of about 50% to 96% of said beta-transus temperature.

6. The process of claim 1 wherein said cooling step (f), following dehydrogenation, is conducted at a cooling rate of about 5° to 40° per minute.

7. The process of claim 1 wherein said titanium alloy is selected from the group consisting of alpha and alpha-beta titanium alloys.

8. The process of claim 7 wherein said alloy is Ti-6Al-4V, wherein said heat treating step (b) is carried out at about 1025° C. for about 20 minutes followed by water quenching; wherein said hydrogenation step (c) is carried out at about 595° C. and the resulting level of hydrogen is less than about 120 ppm.

* * * * *